US010241455B2

(12) United States Patent
Fukamachi et al.

(10) Patent No.: US 10,241,455 B2
(45) Date of Patent: Mar. 26, 2019

(54) FIXING DEVICE HAVING A PRESSING MECHANISM THAT PRESSES FIRST AND SECOND ROTATABLE MEMBERS TOGETHER

(71) Applicant: CANON KABUSHIKI KAISHA, Tokyo (JP)

(72) Inventors: Asuna Fukamachi, Kashiwa (JP); Masanobu Tanaka, Kashiwa (JP); Suguru Takeuchi, Funabashi (JP); Oki Kitagawa, Nagareyama (JP); Yasuharu Toratani, Abiko (JP); Keita Ishiguro, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/997,162

(22) Filed: Jun. 4, 2018

(65) Prior Publication Data

US 2018/0348683 A1 Dec. 6, 2018

(30) Foreign Application Priority Data

Jun. 5, 2017 (JP) ..... 2017-110673
May 2, 2018 (JP) ..... 2018-088695

(51) Int. Cl.
*G03G 15/20* (2006.01)

(52) U.S. Cl.
CPC ..... *G03G 15/206* (2013.01); *G03G 15/2039* (2013.01); *G03G 15/2057* (2013.01)

(58) Field of Classification Search
CPC ..... G03G 15/206; G03G 15/2039; G03G 15/2057
See application file for complete search history.

(56) References Cited

U.S. PATENT DOCUMENTS

| | | | | |
|---|---|---|---|---|
| 8,208,833 | B2 | 6/2012 | Kitagawa | |
| 8,554,099 | B2 | 10/2013 | Kitagawa | |
| 8,655,213 | B2 | 2/2014 | Tanaka et al. | |
| 9,274,467 | B2 | 3/2016 | Takeuchi et al. | |
| 9,372,450 | B2 | 6/2016 | Kitagawa et al. | |
| 9,405,247 | B2 * | 8/2016 | Kondo | G03G 15/206 |
| 9,405,251 | B2 | 8/2016 | Tanaka | |
| 9,488,942 | B2 * | 11/2016 | Ishimori | G03G 15/2032 |

FOREIGN PATENT DOCUMENTS

| | | | |
|---|---|---|---|
| JP | 2012-068401 | A | 4/2012 |
| JP | 2012-118371 | A | 6/2012 |

* cited by examiner

*Primary Examiner* — Hoang Ngo
(74) *Attorney, Agent, or Firm* — Venable, LLP

(57) ABSTRACT

A fixing device includes first and second rotatable members that form a nip for fixing a toner image on a recording material, and a pressing mechanism that presses one of the first and second rotatable members toward the other. A pressure P1 at a first position, in an upstream side of a center of a recording material feeding direction, and which is a maximum pressure in the nip, an average pressure P0 from the first position to a second position, which is a downstream end of the nip in the recording material feeding direction, a toner melt viscosity M1 at the first position, and a toner melt viscosity M2 at the second position, satisfy: 0.3 MPa≤P1≤0.6 MPa, 0<P0≤0.25 MPa, $1.0\times10^4$ Pa·s≤M1<$1.0\times10^5$ Pa·s, and $0.5\times10^2$ Pa·s≤M2≤$1.0\times10^3$ Pa·s.

6 Claims, 8 Drawing Sheets

| | | P. CONDITION | MAX. SURFACE P. | GROSS | GRAININESS | |
|---|---|---|---|---|---|---|
| MELT VISCOSITY AT MAX. SURFACE P. | $1\times10^5$ | (1) | 0.4 | × | ○ | COMP. EX. (1) |
| | $5\times10^4$ | (2) | 0.4 | ○ | ○ | EMB. |
| | $5\times10^3$ | (3) | 0.4 | ○ | × | COMP. EX. (3) |
| | $5\times10^4$ | (4) | 0.25 | × | ○ | COMP. EX. (4) |
| | $5\times10^4$ | (5) | 0.4 (SHORT NIP TIME) | × | ○ | COMP. EX. (5) |
| | $5\times10^4$ | (6) | 0.4 (RAISE AVE. P. FROM MAX. SURF. P. POSITION TO NIP EXIT. TO 0.3 MPa) | × | ○ | COMP. EX. (6) |

Fig. 5

FIXING DEVICE HAVING A PRESSING MECHANISM THAT PRESSES FIRST AND SECOND ROTATABLE MEMBERS TOGETHER

This application claims the benefit of Japanese Patent Application No. 2017-110673, filed on Jun. 5, 2017, and No. 2018-088695, filed on May 2, 2018, which are hereby incorporated by reference herein in their entireties.

FIELD OF THE INVENTION AND RELATED ART

The present invention relates to a fixing device that is mountable in an image forming apparatus, such as a copying machine, a printing machine, a facsimile machine, and the like.

A fixing device, employed by an image forming apparatus provided with an image forming portion (electrophotographic image forming portion, for example), for fixing a toner image transferred onto a sheet of recording medium, has a heating member as a fixing member, and a pressure applying member disposed in a manner to be pressed on the fixing member. As a sheet of recording medium, which bears an unfixed toner image, is conveyed through a nip formed by a combination of the fixing member and pressure applying means, the unfixed image on the sheet is fixed to the sheet.

More concretely, in the nip, the toner (toner particles), of which a toner image is formed, is heated to a temperature level greater than the glass transition temperature while remaining under the pressure applied by the pressure applying member. As the toner is heated to a temperature greater than the glass transition temperature, it becomes adhesive and elastic, while remaining under the pressure applied by the pressure applying member. That is, the toner image (toner particles) is subjected to a proper amount of pressure while remaining viscous, after being softened, and adhesive. Consequently, the toner particles are flattened and adhered to the sheet.

As toner particles are heated while being subjected to pressure, they change in shape and/or adhere to each other, forming, therefore, a thin layer of toner on the sheet of recording medium. Since the toner particles are under the pressure applied by the pressure applying member, the thin layer of toner is pressed upon the sheet. As the sheet of recording medium is conveyed out of the nip, the thin layer of toner cools down, and becomes fixed to the sheet. This process of fixing a toner image on a sheet of recording medium to the sheet by the application of heat and pressure to the sheet and the toner image thereon has sequential steps of melting, deforming, flattening, and adhering.

If a toner image having half-tone areas is excessively heated and/or pressed during a fixation process, in order to provide the surface of the toner image with gloss, the toner particles in the unfixed toner image excessively melt and spread, changing, therefore, in position and/or size. That is, as an unfixed toner image is excessively heated and/or pressed during the fixation process, it turns into a fixed toner image that is inferior in terms of graininess.

There is disclosed, in Japanese Laid-open Patent Application No. 2012-68401, an image forming apparatus structured to increase the difference in temperature between the top and bottom surfaces of a sheet of recording medium, and also, to be less in the amount of pressure applied to a toner image (toner particles) in order to prevent melted (softened) toner particles from excessively spreading. Further, there is disclosed, in Japanese Laid-open Patent Application No. 2012-118371, an image forming apparatus structured to coat a color toner image with transparent toner, which is lower in softening point than the toners of which the color toner image is formed, in order to prevent color toner particles from excessively spreading as they soften (melt).

The conventional technologies described above suffer, however, from the issue that, if a fixing device is structured to prevent toner particles from excessively spreading as they soften (melt), in order to improve the apparatus in terms of the graininess of an image, it is impossible to improve the apparatus in terms of glossiness of an image, without affecting the apparatus in terms of the graininess of an image.

SUMMARY OF THE INVENTION

Thus, a primary object of the present invention is to provide a fixing device that can prevent toner particles from excessively spreading as they soften (melt), in order to obtain an image that is excellent in terms of graininess, and also, that is capable of outputting an image that is excellent in graininess, and yet, is desirable in glossiness.

According to one aspect, the present invention provides a fixing device comprising first and second rotatable members cooperative with each other to form a nip for fixing a toner image on a recording material, and a pressing mechanism configured to press at least one of the first and second rotatable members toward the other, wherein a pressure P1, at a first position in an upstream side of a center of a recording material feeding direction, is maximum in the nip, an average pressure P0 from the first position to a second position, which is at a downstream end of the nip in recording material feeding direction, a toner melt viscosity M1 at the first position, and a toner melt viscosity M2 at the second position, satisfy the following:

$$0.3\ \text{MPa} \le P1 \le 0.65\ \text{MPa}.$$

$$0 < P0 \le 0.25\ \text{MPa},$$

$$1.0\times10^{4}\ \text{Pa·s} \le M1 < 1.0\times10^{5}\ \text{Pa·s, and}$$

$$0.5\times10^{2}\ \text{Pa·s} \le M2 \le 1.0\times10^{3}\ \text{Pa·s}.$$

Further features of the present invention will become apparent from the following description of exemplary embodiments with reference to the attached drawings.

Figure 4:
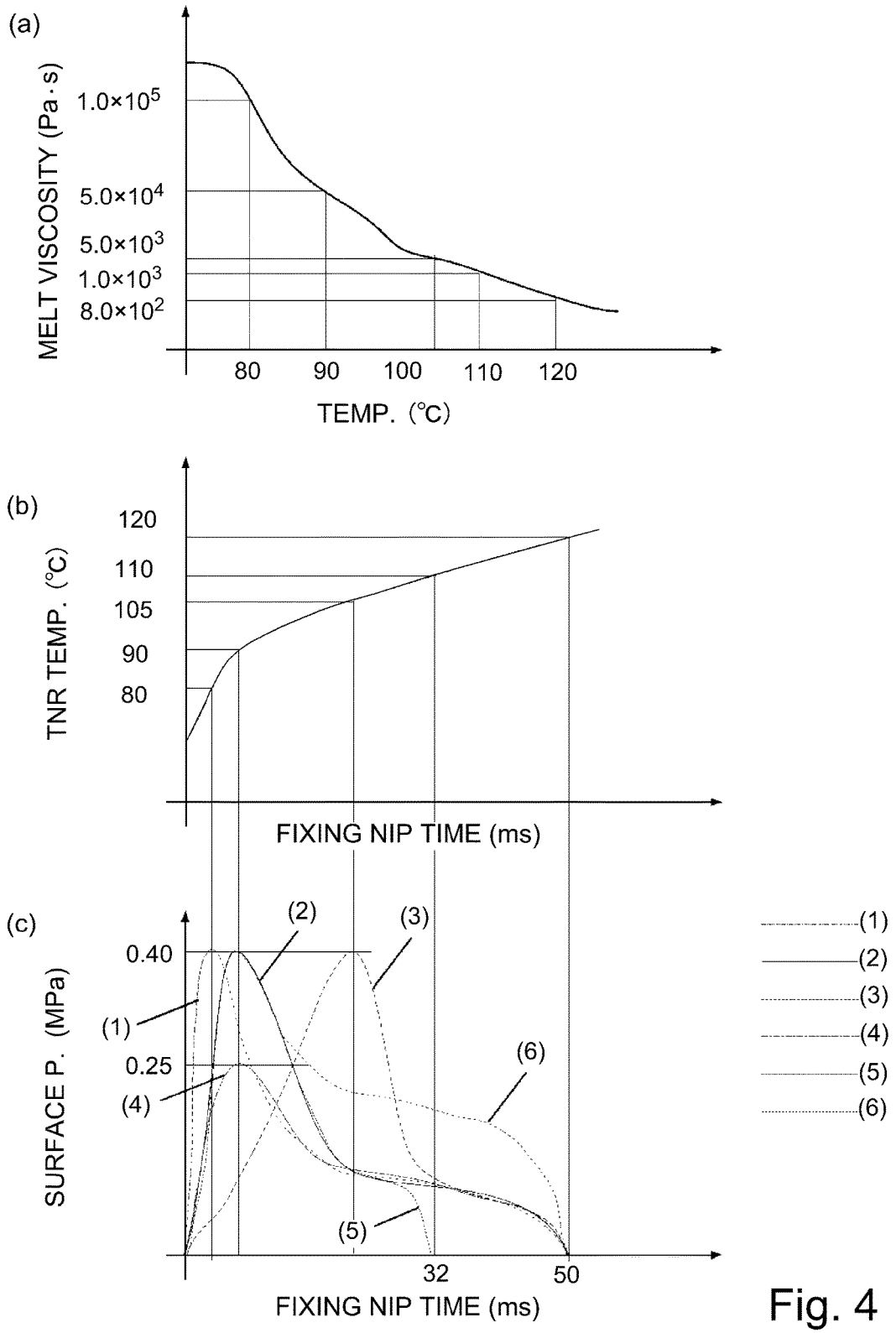

Parts (a), (b), and (c) of FIG. 4 are graphs of a toner viscosity, a toner temperature, and a pressure distribution in the fixation nip, respectively, in the first embodiment.

FIG. 5 is a table for showing the effectiveness of the first embodiment of the present invention, in comparison to those of comparative fixing devices.

Figure 6:
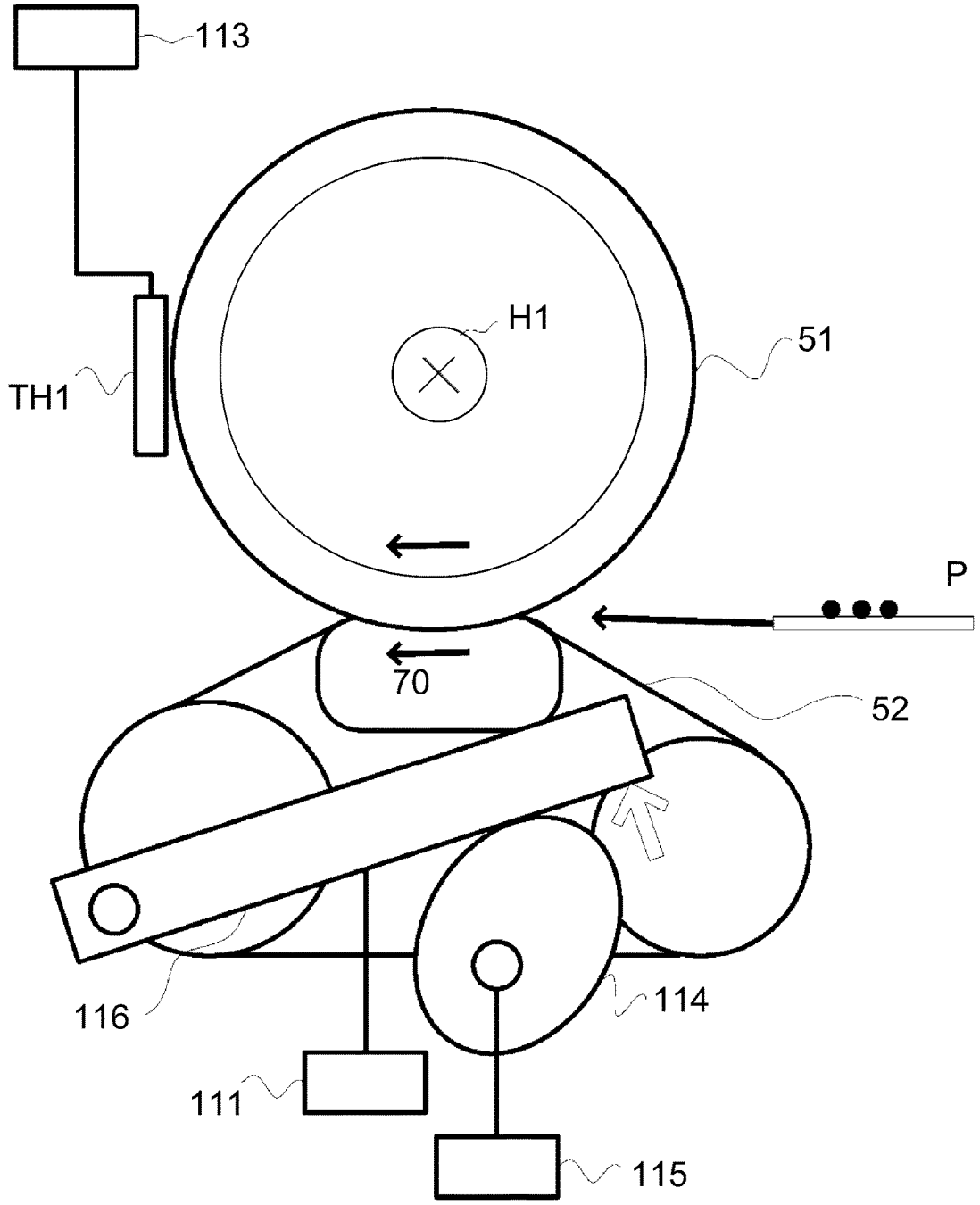

FIG. 6 is a sectional view of the fixing device in a second embodiment of the present invention.

Figure 7:
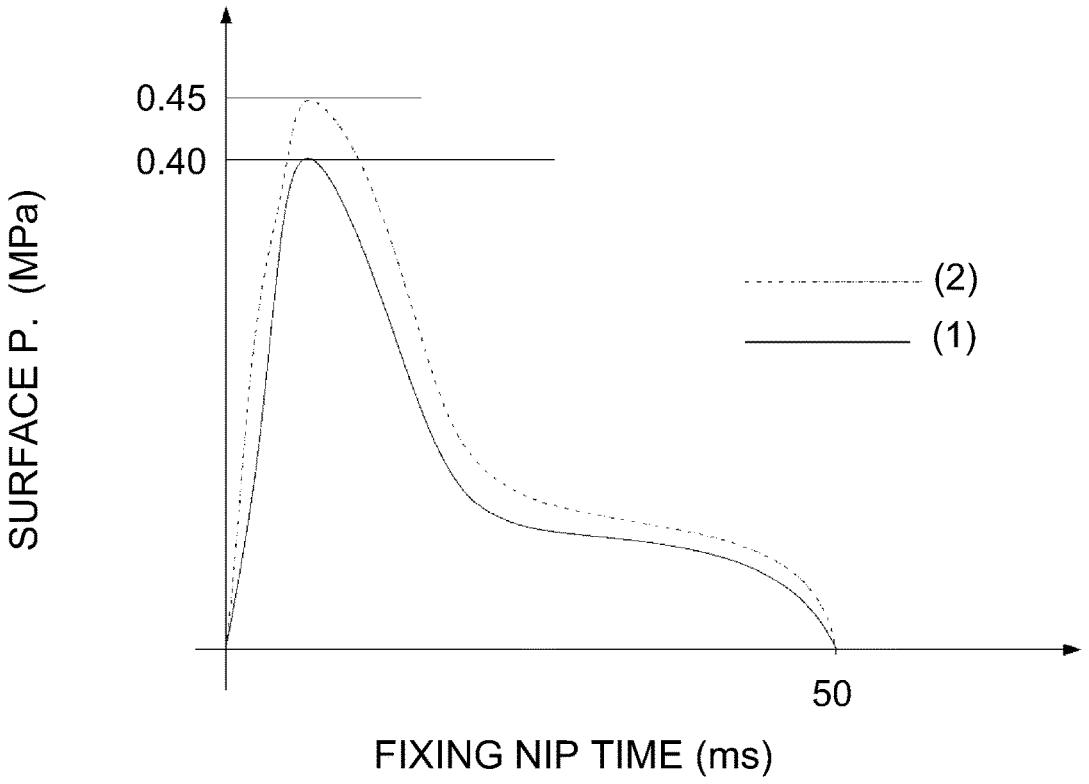

FIG. 7 is a graph that shows the relationship between the surface pressure distribution in the fixation nip in the second embodiment.

Figure 8:
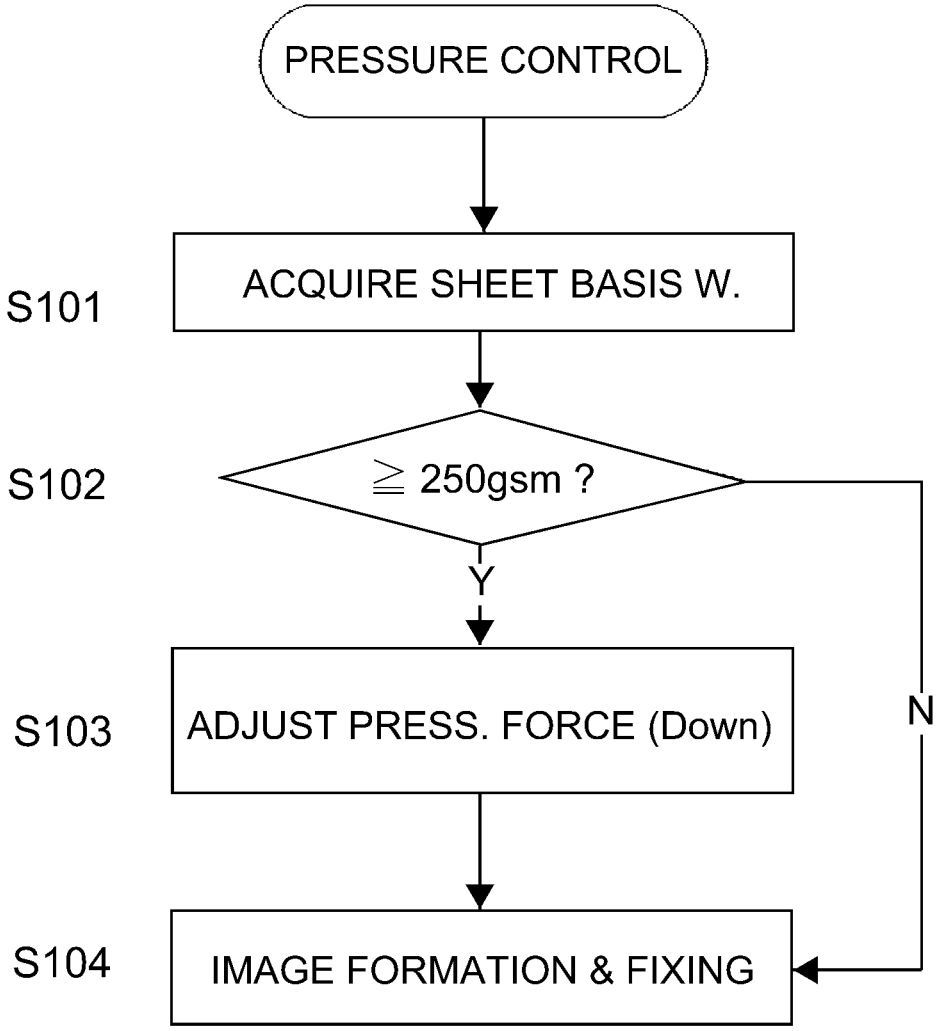

FIG. 8 is a flowchart of the nip pressure adjustment operation in the second embodiment.

Figure 9:
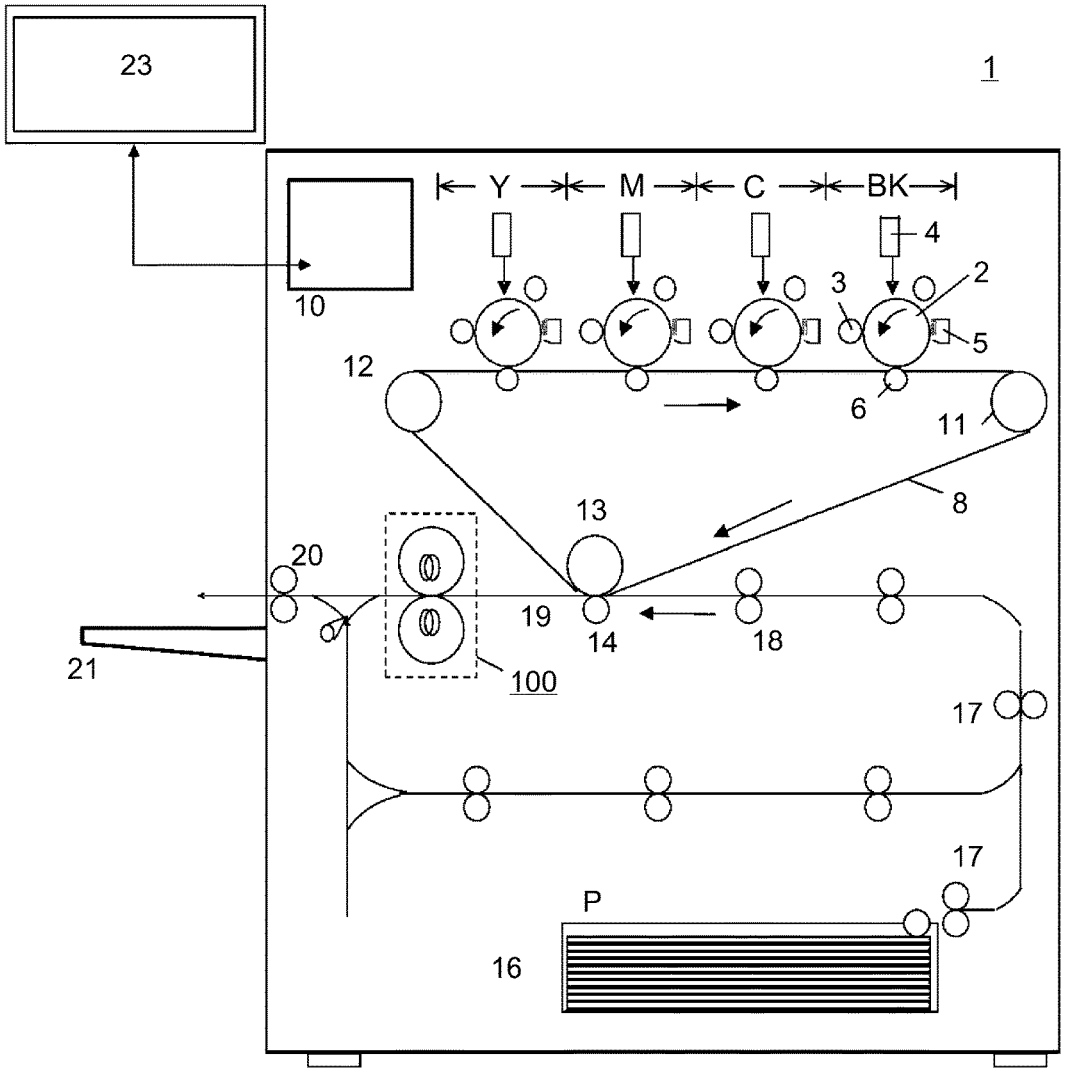

FIG. 9 is a sectional view of an image forming apparatus having a fixing device that is in accordance with the present invention.

DESCRIPTION OF THE EMBODIMENTS

Hereafter, embodiments of the present invention are described with reference to appended drawings.

Embodiment 1

Image Forming Apparatus

To begin with, referring to FIG. 9, an overall structure of an image forming apparatus 1 having a fixing device 100, which is in accordance with the present invention, is described. The image forming apparatus 1 is a color laser beam printer, which uses an electrophotographic image formation system. Hereafter, this electrophotographic color printer is referred to simply as a "printer".

The printer 1 shown in FIG. 9 has four image forming portions that form yellow (Y), magenta (M), cyan (C), and black (Bk) toner images, one for one. In each image forming portion, a photosensitive drum 2 is charged by a charge roller 3. Then, a latent image is formed on the charged portion of the peripheral surface of the photosensitive drum 2 by a laser scanner 4. The latent image is developed into a toner image (image formed of toner) by a developing device 5. Then, the toner images on the peripheral surfaces of the photosensitive drums 2 are sequentially transferred onto an intermediary transfer belt 8, for example, which is an image bearing member.

Meanwhile, the sheets P of recording medium (paper, for example), in a sheet-feeding cassette, are fed one by one into the main assembly of the image forming apparatus 1, while being separated from the rest of the sheets P in the cassette by the operation of a sheet-feeding mechanism. Then, each sheet P is sent to a pair of registration rollers 18 through a sheet conveyance passage 17. The pair of registration rollers 18 are kept stationary until the sheet P comes into contact with the nip between the pair of registration rollers 18. Thus, if the sheet P happens to be delivered askew to the nip, it is corrected in attitude (straightened) by the nip. Then, the sheet P is conveyed by the pair of registration rollers 18 to the area of contact between the intermediary transfer belt 8 and a secondary transfer roller 14, with such timing that the sheet P arrives at the nip at the same time as the toner image (images) on the intermediary transfer belt 8.

The monochromatic color toner images on the intermediary transfer belt 8 are transferred onto the sheet P by the secondary transfer roller 14, which is a transferring member. Thereafter, the sheet P and the toner images thereon are pressed, while being heated, by the fixing device 100. Consequently, the toner images become fixed to the sheet P. Then, the sheet P, to which the toner images have just been fixed, is discharged into a delivery tray 21 by a pair of discharged rollers 20.

Figure 3:
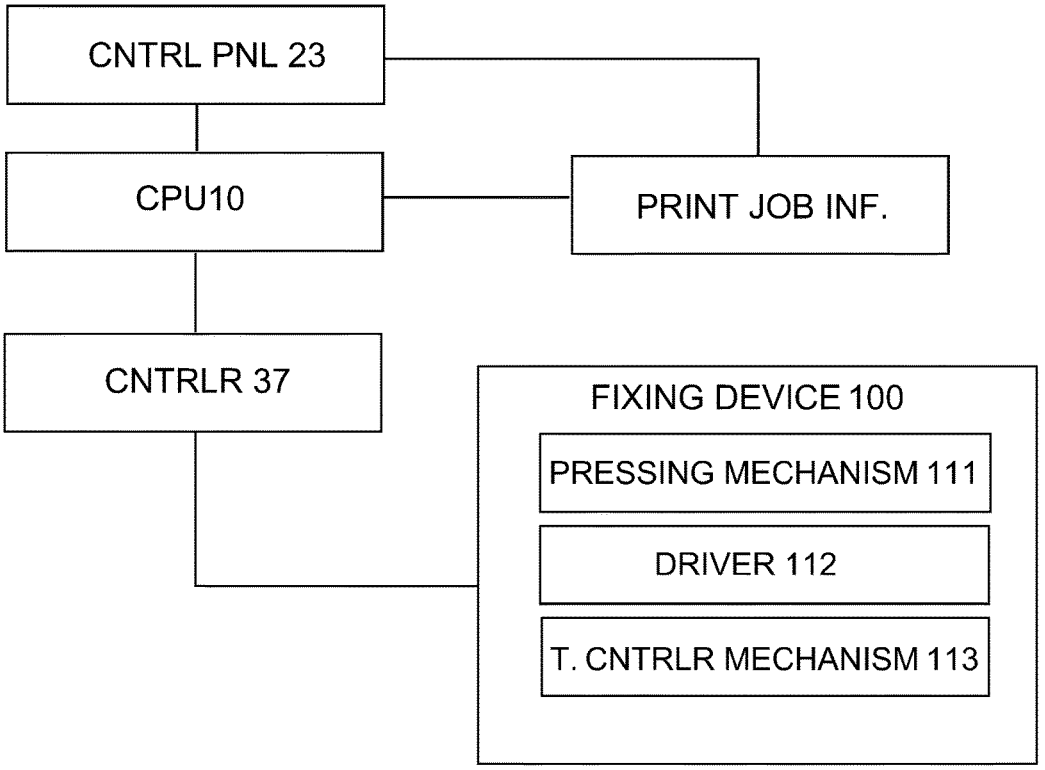
FIG. 3 is a block diagram of a part of a control system of an image forming apparatus (and of the fixing device, in particular) in the first embodiment.

Referring to FIG. 3, the image forming apparatus 1 also includes a control portion, which typically is a central processing unit (CPU) 10, a controller 37 that controls the fixing device 100 and its peripheral devices, and a control panel 23 that functions as an interface between the image forming apparatus 1 and a user. The CPU 10 manages the overall operation of the image forming apparatus 1 by controlling the chain of commands among units while checking and controlling each section of the apparatus 1.

The image forming apparatus 1 is structured so that the control panel 23 is usable by a user to input basic settings (recording medium information, such as basis weight and surface properties, print count of a job, or a printing mode (one-sided or two-sided mode, etc.)) for a printing job. By the way, the information regarding a print job can be inputted into the image forming apparatus 1 from an external personal computer (PC), or the like, beside the control panel 23. The controller 37 controls a motor for driving the fixing device 100, a separation-connection motor, etc.

Fixing Device

Regarding the orientation of fixing members of the fixing device 100 in this embodiment, which is to be described next, the "lengthwise direction" is such a direction that is perpendicular to the recording medium conveyance direction, and to the thickness direction of recording medium.

Figure 1:
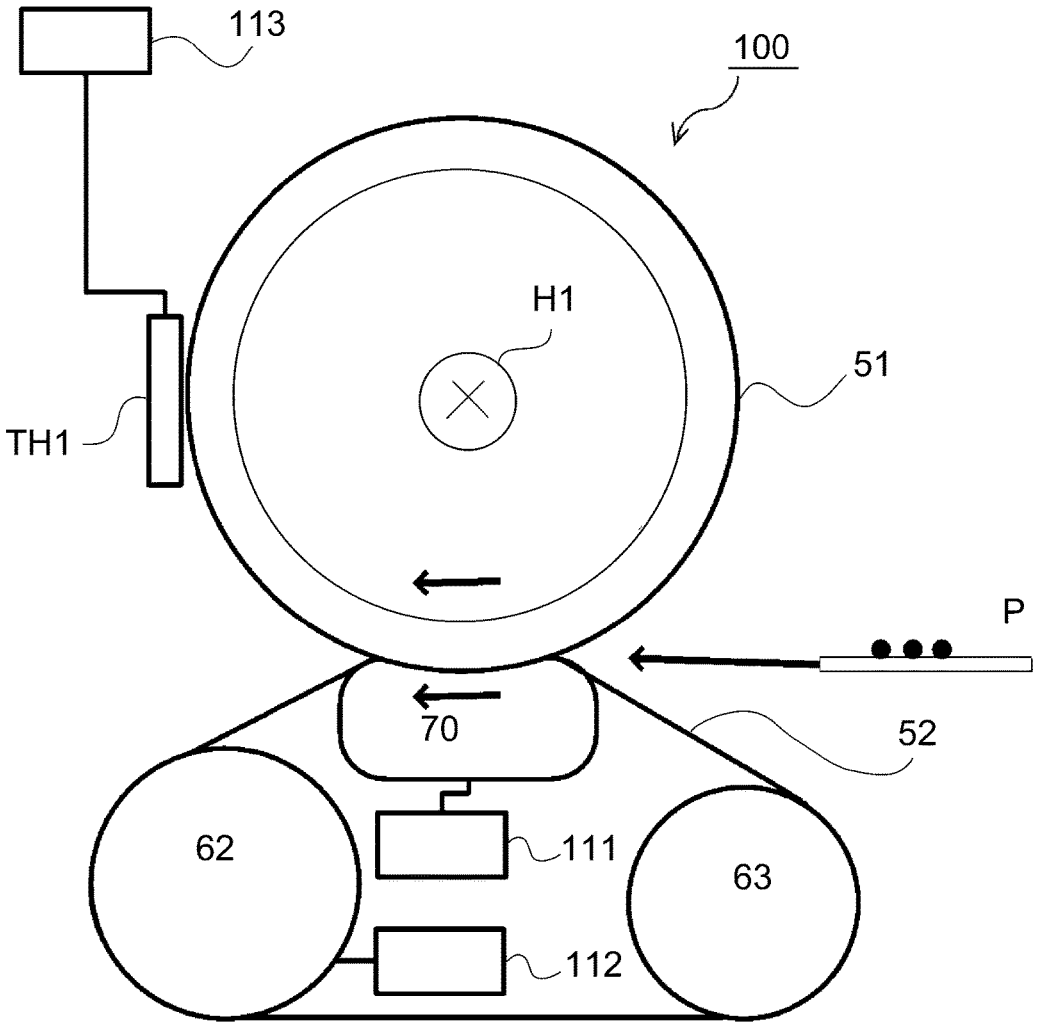
FIG. 1 is a sectional view of a fixing device in a first embodiment of the present invention.

The fixing device 100 shown in FIG. 1 has first and second rotational members. The first rotational member is a fixation roller 51. The second rotational member is a pressure belt 52, which is an endless belt and is rotationally movable while being kept pressed upon the fixation roller 51. The lengthwise direction of the pressure belt 52 coincides with the aforementioned "lengthwise direction". The fixing device 100 is also provided with a combination of a pressure pad 70, and a pair of springs 111 (pressure applying means), disposed at the lengthwise ends of the pressure pad 70, to apply pressure to the pressure pad 70. As a sheet P of recording medium, which bears a toner image (image), is conveyed through the nip while remaining pinched between the fixation roller 51 and the pressure belt 51, the toner image is fixed to the sheet P.

By the way, in FIG. 1, referential codes 112 and 113 stand for a driving mechanism and a temperature controlling system, respectively.

The fixation roller 51 is made up of a metallic core formed of aluminum (Al), iron (Fe), or the like, and an elastic layer formed of silicon rubber, fluorine rubber, or the like, in a manner to cover the peripheral surface of the metallic core. Further, the fixing device 100 is provided with a halogen heater H1, as a heat-generating member (heating means) that is disposed in the hollow of the metallic core in such an attitude that it extends in the lengthwise direction from one end of the metallic core to the other. Further, the fixing device 100 is provided with a thermistor TH1, which is disposed in contact with the fixation roller 51, or with no contact with the fixation roller 51. The halogen heater H1 is turned on or off by the CPU 10 (FIG. 3) to keep the surface temperature of the fixation roller 51 at a preset level, for example, 180° C.

The fixation roller 51 is rotationally driven by a driving force source (unshown), in the direction indicated by an arrow mark, at a preset peripheral velocity, for example, 400 mm/sec, with the pressure belt 52 being kept pressed against the fixation roller 51. The pressure belt 52 is made up of a substrative layer, and an elastic layer formed on the outward surface of the substrative layer. The substrative layer is formed of resinous substance, such as polyimide, or a metallic substance, such as nickel. The pressure belt 52 is suspended and kept tensioned by a combination of a driving roller 62 and a tension roller 63. The pressure belt 52 is rotationally driven by the driving force inputted into the driving roller 62 from a driving force source (unshown).

Figure 2:
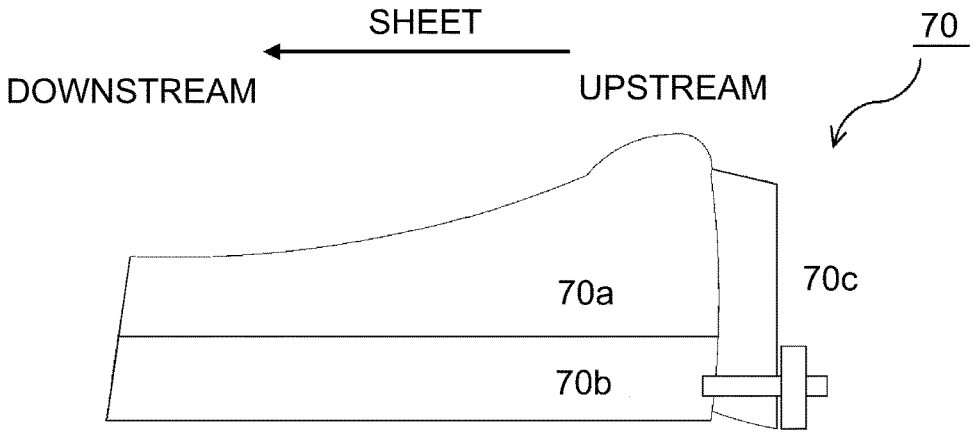
FIG. 2 is a sectional view of a pressure pad (pressure applying member) in the first embodiment.

In this embodiment, the fixing device 100 is structured so that the nip pressure is greater on the entrance side of the nip (upstream side of center of nip in terms of recording medium conveyance direction), as will be described later. FIG. 2 is a schematic sectional view, at a plane perpendicular to the lengthwise direction of the fixing device 100, of the pressure pad 70, which is capable of providing a fixation nip with such a pressure distribution that is greater in pressure on the entrance side, in terms of the recording medium conveyance direction than the exit side. FIG. 2 shows an example of the shape of a pressure pad capable of providing the fixation nip with the above-described pressure distribution.

Referring to FIG. 2, the pressure pad 70 is shaped so that, in terms of the direction perpendicular to the recording medium conveyance direction, an elastic layer 70*a* is thicker on the upstream side than the downstream side. That is, the pressure pad 70 has such an elastic layer 70*a* that is thickest at a first position, which is on the upstream side with reference to the center of the nip, and gradually reduces in thickness toward the downstream end.

When the nip pressure is P1 at the first position, which is on the upstream side of the center of the nip in terms of the recording medium conveyance direction, and at which the nip pressure is greatest, the average nip pressure between the first position and a second position, which corresponds to the downstream end of the fixation nip, in terms of the recording medium conveyance direction, and which is on the downstream side of the first position, is P0, the toner viscosity at the first position is M1, and the toner viscosity at the second position is M2, the following four conditions are satisfied:

$$0.3\ \text{MPa} \le P1 \le 0.65\ \text{MPa},$$

$$0 < P0 \le 0.25\ \text{MPa},$$

$$1.0\times10^4\ \text{Pa·s} \le M1 < 1.0\times10^5\ \text{Pa·s, and}$$

$$0.5\times10^2\ \text{Pa·s} \le M2 \le 1.0\times10^3\ \text{Pa·s}.$$

Preferably, the following four conditions are satisfied:

$$0.3\ \text{MPa} \le P1 \le 0.5\ \text{MPa},$$

$$0 < P0 \le 0.25\ \text{MPa},$$

$$5.0\times10^4\ \text{Pa·s} \le M1 \le 1.0\times10^5\ \text{Pa·s, and}$$

$$0.5\times10^2\ \text{Pa·s} \le M2 \le 1.0\times10^3\ \text{Pa·s}.$$

The pressure pad 70 has two layers, that is, a base layer 70*b* formed of stainless steel, and the elastic layer 70*a* formed of silicon rubber and adhered to the base layer 70*b*. The fixing device 100 is also provided with a friction-reducing member (unshown) that is disposed between the pressure pad 70 and the pressure belt 52 to minimize the friction between the pressure pad 70 and the pressure belt 52, which rub against each other as the fixation roller 51 is rotationally driven. This friction-reducing member is a piece of glass cloth coated with fluorinated resin, such as polytetrafluoroethylene (PTFE), to make the friction-reducing member more slippery.

Further, referring to FIG. 2, in this embodiment, the fixing device 100 is provided with a supporting member 70*c* attached to the upstream surface (nip entrance side) of the base layer 70*b* of pressure pad 70 to ensure that the elastic layer 70*a* holds its shape even when the elastic layer 70*a* comes under pressure.

The pressure pad 70 is nonrotational. The pressure pad 70 is disposed on the inward side of the loop (belt loop) that the pressure belt 52 forms, and keeps the pressure belt 52 pressed upon the peripheral surface of the fixation roller 51 across the area between the entrance (upstream) side of the nip to the exit (downstream) side of the nip. In addition, the pressure pad 70 is kept pressed toward the fixation roller 51 by pressure application mechanisms disposed on the base side of the pressure pad 70, with the presence of the pressure belt 52 between itself and the fixation roller 51.

That is, a pair of pressure application mechanisms 111 (comprising springs (FIG. 1)) are disposed on the lengthwise ends of the base layer 70*b* of the pressure pad 70, one for one. Thus, the pressure pad 70, which is under the pressure from the pressure application mechanisms 111, keeps the pressure belt 52 pressed upon the fixation roller 51. Further, the fixing device 100 is provided with an unshown cam and an unshown cam driving mechanism. Thus, the amount by which pressure is applied to the pressure pad 70 can be adjusted by rotationally driving the cam with use of the cam driving mechanism to change the cam in angle (phase).

In this embodiment, cyan, magenta, yellow, and black toners, which contain wax, are used as the toners for forming unfixed toner images. The image data to be input into the image forming portions are the data (600 dots per inch (dpi), and 0 to 255) regarding the primary colors C, M, Y, and K, to which an original image to be copied, or a nonoriginal image to be formed, are separated. Here, the amount of data per pixel is referred to as an image data amount. The maximum amount of data per primary color is 100%. The amount by which toner is used to form each pixel is calculated based on the image data amount, which is in a range of 0% to 100%.

A "toner amount" is the amount by which toner is used to form each of the pixels, of which an image is formed. The toner amount is expressed by a value in a range of 0% to 100%, like the image data amount. The weight of the toner adhered to the recording medium per 1 $cm^2$ to form an image is referred to as "toner load". Thus, when an image is monochromatic, and 100% in toner amount, the image is a maximum in toner load, and is highest in density. In this embodiment, the image forming apparatus 1 is adjusted in toner load so that a halftone image is 0.5 $mg/cm^2$ in each primary color. Also, in this embodiment, paper (gloss coat paper, which is 128 $g/m^2$ in basis weight) was used as a recording medium (sheet P of paper).

In the nip (fixation nip), toner is heated to a temperature level greater than the glass transition temperature while being kept under pressure. Thus, as the toner softens enough for its viscosity to reduce to a preset level, the toner particles spread and adhere to a sheet P of recording medium. If the toner particles excessively spread, it is possible that the toner image will be changed in position and/or size, and also, the resultant fixed image will be inferior in terms of graininess.

In this embodiment, therefore, in order to minimize the amount by which toner particles spread as they soften (melt), the fixing device 100 is structured so that a sheet P of recording medium is subjected to the greatest amount of pressure (maximum surface pressure) when a given point of the sheet P in terms of the recording medium conveyance direction is in a position of the nip, which is very close to the upstream end of the nip, and in which the toner temperature will be 90° C., that is, as soon as the given point of the sheet P enters the nip, and then, the nip pressure gradually reduces toward the downstream end of the nip. That is, by applying relatively high pressure to the toner on a sheet of recording medium when the toner is relatively high in viscosity, it is possible to make the toner particles in the toner image to deform to such a degree that the area of contact between each toner particle to a sheet P of recording medium becomes sufficient in size, the toner particles in the bottom portion of the toner layer do not excessively spread, and the toner particles in the top portion of the toner layer satisfactorily adhere to each other.

In terms of the conventional definition, "nip time" is a value obtained by dividing the nip width (dimension of nip in terms of recording medium conveyance direction) by a fixation speed. In this specification, however, it sometimes means the length of time it takes for a given point of a sheet P of recording medium in terms of the recording medium conveyance direction to reach the downstream end of the nip after the point is subjected to the maximum amount of surface pressure in the nip. In this embodiment, the fixing device 100 is structured so that, after the application of the greatest amount of surface pressure to the toner image, the amount by which pressure is applied to the toner image (toner particles) is kept minimum (which includes zero).

That is, the amount of time it takes for a given point of a sheet P of recording medium, in terms of the recording medium conveyance direction, to move from the first position, in which the point is subjected to the greatest amount of nip pressure, to the downstream end (second position) of the nip in terms of the recording medium conveyance direction, is greater that the amount of time it takes for the point to reach the first position, or the position in which the point is subjected to the greatest amount of nip pressure, after it enters the nip. That is, the amount of time it takes for the leading edge of the sheet P in terms of the recording medium conveyance direction to reach the downstream end (second position) of the nip after it is subjected to the greatest pressure in the first position is greater that the amount of time it takes for the leading edge of the sheet P in terms of the recording medium conveyance direction, to be subjected to the greatest pressure in the nip after entering the nip. Similarly, the amount of time it takes for the leading edge of the image formation area of the sheet P, in terms of the recording medium conveyance direction, to move from the first position, in which the point is subjected to the greatest amount of nip pressure, to the downstream end of the nip, is greater that the amount of time it takes for the point to reach the first position after it enters the fixation nip. Therefore, it is possible to melt the toner particles in the top portion of the toner layer on the sheet P by the amount of heat given to the toner image during the nip time, in order to make the toner layer flat across its top surface so that the toner image will be glossy after the fixation.

Part (a) of FIG. 4 shows the relationship among a location in the nip, in terms of the recording medium conveyance direction, a temperature (toner temperature) at the location, and the toner viscosity at the location. Part (b) of FIG. 4 shows the relationship between a location in the nip, in terms of the recording medium conveyance direction, and the temperature (toner temperature) at the location. The solid line in part (c) of FIG. 4 represents the relationship among a location in the nip, in terms of the recording medium conveyance direction, the nip pressure (surface pressure), and a nip time.

The toner viscosity was measured with the use of a Flow Tester CFT-500D (product of Shimazu Co., Ltd.), under the following conditions (a) to (e), following the operational manual for the tester. In this embodiment, the binder of the color toners was polyester. The method used for manufacturing the color toners is pulverization. By the way, the toner ingredients and the method for manufacturing the color toner do not need to be limited to those mentioned above. For example, the method for manufacturing the toner may be polymerization, such as suspension polymerization and interfacial polymerization.

Conditions:

(a) Sample: 1.0 g of toner (measured with balance) is placed in a compression molding device, which was 1 cm in diameter, and was compressed for one minute with the application of 20 kN of load to obtain samples, (b) Die diameter: 1.0 mm, (c) Die length: 1.0 mm, (d) Cylinder pressure: $9.807\times10^5$ (Pa), and (e) Measurement mode: warm-up speed: 4.0° C./min.

A toner viscosity (Pa·s) was measured with the use of the above-described method in a temperature range of 50° C. to 200° C.

As for a toner temperature, a sheet P of paper, which was equipped with a thermocouple of type K, was conveyed through the fixation nip while monitoring the temperature, to obtain the toner temperature profile relative to the elapsed length of time while the sheet P is conveyed through the fixation nip.

As for the pressure distribution (surface pressure distribution), it was measured with the use of a tactile sensor (Sealer, a product of Nitta Co., Ltd.), with a sheet P of recording medium held in the nip.

In this embodiment, the fixing device 100 is structured so that the nip pressure become the greatest (4.0 MPa) when the nip temperature is 90° C., at which toner viscosity becomes $5.0\times10^4$ Pa·s, as is indicated by the solid line (Condition 2) in part (c) of FIG. 4. More specifically, the elastic layer 70*a* of the pressure pad 70 shown in FIG. 2 was shaped to satisfy Condition 2. During this process, the temperature of the fixation roller 51 was kept at 185° C. Further, the nip width (nip dimension in terms of recording medium conveyance direction) was 20 mm, and the fixation speed was set to 400 mm/s. Thus, the nip time was 50 ms.

Further, at the nip exit (downstream end of nip), the toner temperature was 120° C. (part (b) of FIG. 4), and the toner viscosity was 800 ($8.0\times10^2$) Pa·s (part (a) of FIG. 4). Further, the fixing device 100 was structured so that the nip pressure is greatest (0.4 MPa in surface pressure) in the immediate adjacencies of the nip entrance, and reduces at a relatively high rate toward the nip exit, and also, so that the average surface pressure between the point in the immediate adjacencies of the nip entrance, at which the toner image (toner particles) is subjected to the greatest nip pressure, and the downstream end of the nip, in terms of the recording medium conveyance direction, was 0.2 MPa.

If the toner viscosity is excessively high when the toner is subjected to the greatest surface pressure, or the greatest surface pressure is too low, toner fails to properly deform, and, therefore, the top surface of the toner layer fails to become flat enough to provide the toner image with a satisfactory gloss. Further, if the downstream half of the fixation nip is insufficient in the amount by which it can provide a sheet P of recording medium with heat, the top surface of the toner layer does not become flat, and, therefore, fails to provide the toner image with a sufficient gloss, even if the nip is proper (greatest) in surface pressure. Further, if the toner is insufficient in viscosity when it is subjected to the greatest amount of surface pressure, or if an excessive amount of pressure is applied to the toner when the toner is low in viscosity, the toner particles excessively spread, reducing thereby the toner image in graininess (clearness).

Thus, the fixing device 100 was changed in the location in the nip, in terms of the recording medium conveyance direction, at which the surface pressure is greatest, in order to change the fixing device 100 in the viscosity that toner particles will have when they are subjected to 4.0 MPa of surface pressure, that is, the greatest surface pressure. Then, the fixed images were evaluated in gloss and graininess. The fixed images were also evaluated in gloss and graininess under the condition in which the fixing device 100 was reduced in the amount of the greatest surface pressure, reduced in the amount of nip time, that is, the amount of time that elapses between the point in time at which the greatest surface pressure is applied, and the downstream end of the nip, and increased in the average surface pressure between the point at which the fixing device 100 was greatest in surface pressure, and the sheet exit of the fixing device 100. The experiments that involved the changes in the pattern of the pressure distribution in the nip were carried out by changing the pressure pad 70 in shape, or changing the fixing device 100 in the amount by which pressure was applied.

The degree of glossiness (which hereafter will be referred to simply as "gloss") of the fixed images was measured with the use of a Handy Gloss Meter (PG-1M, a product of Nippon Denshoku Industries Co., Ltd.) (in accordance with specular glossiness measuring method JIS Z8741). When a fixed toner image was no less than a preset value in 60° glossiness value, the toner image was judged excellent in glossiness (o in glossiness column in FIG. 5 indicates that the toner image was satisfactory in gloss, whereas x indicates that the toner image was unsatisfactory in gloss).

Graininess was measured with the use of Wiener spectral, which is a power spectral of density fluctuation. The values obtained by integrating the Wiener spectral of an image and a Visual transfer function (VTF) after cascading was used as a graininess index (GS). The greater a toner image is in GS value, the more inferior it is in graininess (Referential documents: R. P. Dooley, R. Show, "Noise Perception in Electrophotography," J. Appl. Photogr. Eng., 5(4)). In this embodiment, when a toner image is no greater in GS than a preset value, it is judged excellent (satisfactory) in graininess ((o in glossiness column in FIG. 5 indicates that the toner image was satisfactory in glossiness, whereas x indicates that the toner image was unsatisfactory in glossiness).

Regarding Conditions (1) to (6) shown in FIG. 5, the surface pressure distribution is shown in part (c) of FIG. 4, and the results of the evaluation of toner images in glossiness are shown in FIG. 5. In part (c) of FIG. 4, a solid line (2) corresponds to this embodiment, whereas a solid line (1) corresponds to a comparative fixing device (1), and solid lines (3) to (6) correspond to comparative fixing devices (3) to (6).

In Condition (1), in which a surface pressure is greatest, and the toner particles were $1\times10^5$ Pa·s in viscosity (toner temperature was 80° C.), the toner particles did not spread very wide, and the difference among the toner particles in terms of the extent of spreading was small. Thus, the toner images were satisfactory in graininess. The toner particles failed, however, to fully melt, and, therefore, the toner images were not smooth across their top surface, being, therefore, unsatisfactory in gloss. In Condition (3), in which the surface pressure is the greatest, and the toner is $1.0\times10^3$ Pa·s in viscosity (toner temperature was 105° C.), the toner particles spread excessively wide, and therefore, the toner images were unsatisfactory in graininess.

In Condition (4), in which the greatest surface pressure was 0.25 MPa, the toner particles did not spread wide, and the difference among the toner particles in the extent of spreading was small. Thus, the toner images were satisfactory in graininess. The toner particles failed, however, to completely melt. Therefore, the toner images were not as flat across their top surface as they should be. Therefore, they were unsatisfactory in gloss. In Condition (4), even when the greatest surface pressure was increased to 0.65 MPa, the toner images were satisfactory in graininess. But, as the greatest surface pressure was raised to 0.70 MPa, the toner particles excessively spread, and, therefore, the toner images were unsatisfactory in graininess. Further, in Condition (5), when the nip time (amount of time it takes for a given point of a sheet P of recording medium to move from a position in which a surface pressure is greatest in the nip, to a position in the downstream end of nip) was 15 ms, which is relatively short, the toner temperature was 110° C. (part (b) of FIG. 4) (which is substantially lower than 120° C.) at the nip exit (downstream end of nip). Therefore, the amount by which heat was applied to the toner image (toner particles) was insufficient. Therefore, the top surface of the toner image was inferior in terms of flatness. Therefore, the toner images were unsatisfactory in gloss. In this case, the toner (toner image) was $1.5\times10^3$ Pa·s in viscosity at the nip exit (part (a) of FIG. 4). In Condition (5) or (2), as the nip time was extended to 100 ms, the toner images improved in graininess and gloss. As the nip time was extended to 120 ms, however, the toner particles excessively spread, and, therefore, the toner images became unsatisfactory in graininess. In a case in which the nip time was 100 ms, the toner temperature and the toner viscosity were 140° C. and $0.5\times10^2$ MPa, respectively, at the nip exit.

Further, in Condition (6), as the average surface pressure of the downstream half of the fixation nip of the fixing device 100 was increased from 0.25 MPa to 0.3 MPa, the toner particles excessively spread, and, therefore, the toner images became unsatisfactory in graininess.

As will be evident from the foregoing description, the fixing device 100 is desired to be structured so that when the surface pressure is greatest, the toner viscosity is no less than $1.0\times10^4$ Pa·s, or, preferably, $5.0\times10^4$ Pa·s. Regarding the average surface pressure between the point at which the greatest surface pressure is applied, and the nip exit (downstream end of nip), when it is greater than 0 MPa, (therefore, the nip can hold sheet P of recording medium), but no greater than 0.25 MPa, the fixing device 100 is satisfactory in terms of the graininess of the image. Further, when the average surface pressure is in the above-described range, the greatest surface pressure is no less than 0.3 MPa and no more than 0.65 MPa (preferably, 0.5 Mpa), and the nip time (after application of the greatest surface pressure) is greater than 15 ms (preferably, no less than 20 ms) and no more than 100 ms, the toner images become satisfactory in both gloss and graininess. The changes that occur to the glossiness of a toner image are attributable to toner viscosity. The toner viscosity at the nip exit (downstream end of nip) is desired to be no less than $0.5\times10^2$ Pa·s, and no more than $1.5\times10^3$ Pa·s (preferably, $1.0\times10^3$ Pa·s).

By setting the conditions described above, it is possible to prevent the toner particles from excessively spreading as they melt (soften). Therefore, it is possible to obtain images that are satisfactory not only in glossiness, but also in graininess.

As described above, according to this embodiment, the fixing device 100 is structured so that the fixation pressure is greatest in the entrance portion of the fixation nip, and substantially reduces toward the exit portion of the nip. Thus, the amount by which fixation pressure is applied is greatest when toner is relatively high in viscosity, and gradually reduces toward the nip exit. Therefore, it is possible to minimize the amount by which the toner particles excessively spread as they melt (soften). Further, a sufficient amount of nip time is secured to allow the toner particles to sufficiently reduce in viscosity after the application of the greatest amount of fixation pressure to the toner particles. Therefore, the toner particles in the top portion of the toner images (toner layer) are flattened as they are melted (softened) by the heat applied to the sheet P and the toner image thereon. Therefore, it is possible to obtain a fixed image that is satisfactorily high in gloss.

Embodiment 2

FIG. 6 is a sectional view of the fixing device 100 in the second embodiment of the present invention. The characteristic feature of the fixing device 100 in this embodiment is that the fixing device 100 can be adjusted in the amount by which pressure is applied to the pressure pad 70, such as the one in the first embodiment, by the pressure application mechanisms 111, according to the thickness of a sheet P of recording medium. The structural components of the apparatus in this embodiment that are the same in structure as the counterparts in the first embodiment are not described.

In this embodiment, in order to ensure that, even in a case in which a sheet P of recording medium used for a given image forming operation is thicker than an ordinary sheet of recording paper, an image that is no lower in graininess than an image formed on a sheet of ordinary paper, and as high in gloss as an image formed on a sheet of ordinary paper, can be obtained, the fixing device 100 is structured so that its pressure applying means comprising a pressure pad 70 and pressure application mechanisms 111 can be adjusted in the amount by which it can apply pressure to the pressure pad 70. Generally speaking, the greater a sheet P of recording medium is in basis weight, the greater it is in thermal capacity. Therefore, when a sheet P of recording medium, which is thicker than a sheet of ordinary paper, is used as recording medium, a toner image is likely to be supplied with an insufficient amount of heat. Therefore, the toner image (toners particles) on the sheet P of recording medium is likely to fail to sufficiently melt (soften). One of the solutions to this problem is to raise the target temperature for the fixing device 100 to increase toner temperature. As a sheet of recording medium is increased in thickness, however, the surface pressure to which a toner image (toner particles) on the sheet is subjected increases, causing, therefore, the toner particles to excessively spread. Thus, the image forming apparatus 1 sometimes outputs images that are unsatisfactory in graininess.

Referring to FIG. 6, the fixing device 100 is provided with a pair of pressure application mechanisms 111 (comprising springs), which are disposed at the lengthwise ends of the base layer 70*b* of the pressure pad 70, one for one. The pressure pad 70 is pressed against the fixation roller 51, with the presence of the pressure belt 52 between itself and the fixation roller 51, by a pair of pressure application links 116, which are under the pressure generated by the pair of pressure application mechanisms 111, one for one. Thus, the pressure pad 70 presses the pressure belt 52 upon the fixation roller 51. As a pair of cams 114 are rotationally driven by a pair of cam driving mechanisms 115, the cams 114 change in angle (attitude), adjusting, therefore, the amount by which pressure is applied to the fixation nip by the pressure applying means, which includes the pressure pad 70, by way of the pair of pressure application mechanisms 111.

In this embodiment, paper (gloss coat paper, which is 350 g/m$^2$ in basis weight) was used as a recording medium (a sheet P of paper). The pressure distribution was measured with the use of a tactile sensor (Sealer, a product of Nitta Co., Ltd.), while a sheet P of recording medium is in the nip.

The broken line (2) in FIG. 7, which represents Condition (2), shows the relationship between the surface pressure at a given point in the nip, in terms of the recording medium conveyance direction, and the location of the given point in the nip. The solid line (1) in FIG. 7, which represents Condition (1), shows the relationship between the surface pressure and a fixation nip time in the first embodiment. Referring to FIG. 7, when a sheet of paper that is thicker than a sheet of ordinary paper is used as the recording medium, the amount of pressure to which a toner image is subjected (toner particles are subjected) is greater, as indicated by the broken line (2). Thus, it is possible that the toner particles will excessively spread (wider than when ordinary sheet of paper is used as the recording medium).

It is assumed here that the greater a sheet of recording medium is in basis weight, the thicker the sheet. In this embodiment, therefore, the fixing device 100 was structured so that, if the basis weight of recording medium input through the control panel of the image forming apparatus 1 is greater than a preset amount, the amount by which pressure is applied by the above-described pressure applying means is reduced to apply a proper amount of pressure to the toner image (toner particles).

By the way, the fixation temperature was set to 200° C. so that the nip temperature at the nip exit (toner temperature at nip exit) became 120° C. As the aforementioned sheet of recording paper, which bore a toner image, was conveyed through the nip, the toner temperature changed in such a manner that is almost no different from the manner in which the toner temperature changed when a sheet of recording paper (gloss coat paper which is 128 g/cm$^2$ in basis weight) was conveyed, with the target temperature set to 180° C. That is, it was confirmed that there was virtually no change in the relationship between the nip time and the toner viscosity.

FIG. 8 is a flowchart of the operational sequence for adjusting the nip pressure according to the basis weight of a sheet P of recording medium. In step S101, the information regarding the basis weight of a sheet P of recording medium is input through the control panel 23 (FIG. 3). In step S102, the CPU 10 (FIG. 3) determines whether the basis weight, obtained based on the basis weight information input in step S101, is no less than 250 g/m$^2$ to decide whether the nip pressure is to be downwardly adjusted. If the CPU 10 determines that the basis weight is no less than 128 g/m$^2$, and the nip pressure is to be reduced, the CPU 10 proceeds to step S103. If it determines that the basis weight is no more than 250 g/m$^2$ and the fixing device 100 does not need to be adjusted in nip pressure, the CPU 10 proceeds to step S104.

In step S103, the CPU 10 activates the pressure application mechanisms 111 to downwardly adjust the amount of pressure to be applied by the pressure applying means, which includes the pressure pad 70. In step S104, the CPU 10 carries out an image forming operation and a fixing operation.

Also, in this embodiment, the fixing device 100 was structured so that the nip pressure is greatest in the upstream end portion of the nip, in terms of the recording medium conveyance direction, in which the toner particles are greater in viscosity than in the rest of the nip, and substantially reduces toward the downstream end, as in the first embodiment. Therefore, it is possible to minimize the amount by which the toner particles excessively spread as they melt (soften). Further, the fixing device 100 was structured so that there is a sufficient amount of nip time for toner particles to reduce in viscosity after they are subjected to the greatest amount of surface pressure. Therefore, it is possible to melt (soften) the top portion of the toner layer by the heat given to the toner particles during the nip time to flatten the top surface of the toner layer. Therefore, it is possible to obtain fixed images that are high in gloss.

Further, in this embodiment, the amount by which pressure is applied to a sheet P of recording medium is adjusted according to the type (basis weight) of a sheet P of recording medium. Therefore, it is possible to prevent the problem that the amount of pressure to which the toner particles on a sheet P of recording medium are subjected is affected by the thickness of the sheet P. Therefore, it is possible to regulate the amount by which toner particles spread as they melt (soften). Therefore, it is possible to obtain images that are greater in gloss, and yet, are excellent in terms of graininess.

Modifications

In the forgoing description, the present invention was described with reference to two preferred embodiments of the present invention. These embodiments are not intended, however, to limit the present invention in scope. That is, the present invention is also applicable to various fixing devices that are different from those in the preceding embodiments, within the gist of the scope of the present invention.

Modification 1

In the embodiments described above, the pressure pad 70 was shaped so that it is thickest at the first position, or the upstream end portion of the pad in terms of the recording medium conveyance direction, and gradually reduces in thickness toward the downstream end. These embodiments, however, are not intended to limit the present invention in terms of the shape of the pressure pad 70. For example, the present invention is also compatible with a pressure pad 70 that is thickest across an upstream end portion, and reduces in thickness in steps toward the downstream end. Further, it is also compatible with a pressure pad 70 shaped so that it is thickest at the first position and gradually reduces in thickness so that the amount of pressure it generates at the downstream end is zero.

Also, in the embodiments described above, the fixing device 100 was structured so that the endless belt 52 was pressed upon the fixation roller 52. These embodiments, however, are not intended to limit the present invention in scope in terms of the structure of the fixing device 100. For example, the present invention is also applicable to a fixing device 100 structured so that an endless belt is pressed by a pressure roller. That is, the present invention is applicable to any fixing device 100, as long as the device employs a combination of an endless belt and a rotational member, and is structured so that the endless belt and the rotational member are made to press upon each other. Further, the present invention is also applicable to a fixing device 100 that employs a pair of endless belts, and is structured so that one of the endless belts presses upon the other.

Modification 2

In the embodiments described above, the halogen heater H1, as a heat generating member, was disposed in the hollow of the fixation roller 51 as a rotational member. These embodiments, however, are not intended to limit the present invention in scope in terms of the configuration of a fixing device 100. That is, the present invention is also applicable to a fixing device 100 that employs an endless belt and a heater, as a heat generating member, for heating the endless belt, and is structured so that the heater is disposed in contact with the inward surface of the endless belt to heat the belt. Further, the present invention is also applicable to a fixing device 100 that employs an endless belt having a heat generating layer that is made to generate heat by an excitation coil, or electrical power supplied thereto (structured so that endless belt doubles as heat generating member for heating nip).

Modification 3

In the embodiments described above, the recording medium was recording paper. These embodiments, however, are not intended to limit the present invention in terms of recording medium choice. Generally speaking, a recording medium is medium on which a toner image can be formed by an image forming apparatus, and is in the form of a sheet. It includes a sheet of ordinary paper, cardstock, thin paper, etc., which is in a specific or nonspecific form. It also includes an envelope, a postcard, and a seal. Further, it includes a sheet of resinous substance, a sheet of overhead projector (OHP) film, and a sheet of glossy paper. By the way, in the embodiments described above, how a sheet P of recording medium was manipulated was described with the use of such a term as "sheet-feeding". These embodiments are not intended, however, to limit the present invention in scope in terms of the recording medium choice. The application of the present invention is not limited to image forming apparatuses that are compatible with only sheets of paper.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

What is claimed is:

1. A fixing device comprising:

a first rotatable member;

a second rotatable member cooperative with said first rotatable member to form a nip for fixing a toner image on a recording material; and a pressing mechanism configured to press at least one of said first rotatable member and said second rotatable member toward the other, wherein a pressure P1 at a first position, in an upstream side of a center of a recording material feeding direction, and which is a maximum pressure in the nip, an average pressure P0 from the first position to a second position, which is a downstream end of the nip in the recording material feeding direction, a toner melt viscosity M1 at the first position, and a toner melt viscosity M2 at the second position, satisfy:

$$0.3\ \text{MPa} \le P1 \le 0.65\ \text{MPa},$$

$$0 < P0 \le 0.25\ \text{MPa},$$

$$1.0\times10^{4}\ \text{Pa}\le s \le M1 < 1.0\times10^{5}\ \text{Pa}\cdot\text{s, and}$$

$$0.5\times10^{2}\ \text{Pa}\cdot\text{s} \le M2 \le 1.0\times10^{3}\ \text{Pa}\cdot\text{s}.$$

2. The fixing device according to claim 1, wherein the following is satisfied:

$$0.3\ \text{MPa} \le P1 \le 0.5\ \text{MPa, and}$$

$$5.0\times10^{4}\ \text{Pa}\cdot\text{s} \le M1 < 1.0\times10^{5}\ \text{Pa}\cdot\text{s}.$$

3. The fixing device according to claim 1, wherein said first rotatable member includes a pressing pad having an elastic layer that is thickest at the first position in the nip portion, and is thinner than a thickness at the first position in the downstream side of the first position.

4. The fixing device according to claim 3, wherein said pressing mechanism presses said pressing pad toward said second rotatable member.

5. The fixing device according to claim 1, wherein a time period from when a leading edge of the recording material reaches the first position, in which the recording material receives a greatest pressing force, to when the leading edge reaches the downstream end of the nip portion, is greater than a time period from when the leading edge enters the nip to when the leading edge reaches the first position.

6. The fixing device according to claim 1, further comprising a heating portion configured to heat the nip.

* * * * *